United States Patent [19]

Cannan

[11] 3,958,298

[45] May 25, 1976

[54] CLEANING NOZZLE

[75] Inventor: Bernard M. Cannan, Downers Grove, Ill.

[73] Assignee: Servicemaster Industries Inc., Downers Grove, Ill.

[22] Filed: Aug. 1, 1974

[21] Appl. No.: 493,747

[52] U.S. Cl. ..... 15/322

[51] Int. Cl.[2] ..... A47L 7/00

[58] Field of Search ..... 15/320, 321, 322, 345, 15/346

[56] References Cited

UNITED STATES PATENTS

| | | | |
|---|---|---|---|
| 2,270,579 | 1/1942 | Chamberlin et al. | 15/322 X |
| 3,439,374 | 4/1969 | Wisdom | 15/322 X |
| 3,616,482 | 11/1971 | Brycki | 15/322 X |
| 3,747,155 | 7/1973 | Koellisch | 15/322 |
| 3,840,935 | 10/1974 | Fitzgerald, Jr. et al. | 15/322 |

*Primary Examiner*—Peter Feldman
*Assistant Examiner*—C. K. Moore
*Attorney, Agent, or Firm*—Allegretti, Newitt, Witcoff & McAndrews

[57] ABSTRACT

An improved suction head for a surface vacuum cleaning apparatus which includes a glide shoe having slots on the bottom thereof adjacent to the leading and trailing edges of the shoe, a vacuum conduit in fluid communication with the glide shoe slots, a nozzle positioned within the interior of the head and between the leading and trailing glide shoe slots to spray cleaning fluid onto a soiled surface, and means for permitting air to continuously flow to the soiled surface through the interior of the suction head when the glide shoe is in contact with the soiled surface whereby air flows continuously into the slots from both the interior and the exterior of the head during operation so as to assure that substantially all of the cleaning fluid sprayed is drawn into the glide shoe slots.

10 Claims, 15 Drawing Figures

CLEANING NOZZLE

BACKGROUND OF THE INVENTION

This invention relates to an apparatus for cleaning soiled surfaces, particularly textile surfaces such as carpets.

One of the methods and apparatus used by the prior art to clean carpets includes a cleaning head which includes a spray nozzle that sprays a dilute, hot (i.e. 140°F) detergent solution on the surface of a carpet and a single vacuum slot positioned in front of the spray nozzle to remove the detergent solution from the carpet. Because of the construction of the cleaning head, the head can be used to clean carpets only when the cleaning head is being pulled backwards toward the operator.

This prior art apparatus is often referred to as a "steam cleaning" apparatus although steam, in the true sense, is not used in the process. These "steam" cleaning apparatus are extremely heavy and require two men to efficiently operate them. They apply large amounts of water (6–12 gals/100 $ft^2$) to remove all the soil from a carpet simultaneously and as a consequence, often have power requirements which exceed the normal 15 amp circuits found in a residential home. In addition, because large amounts of water which must be used in the cleaning operation, and because the single vacuum slot cannot effectively remove all the water the carpets are typically out of service for long periods of time (12–48 hours, longer in humid weather).

These steam cleaning processes work on the principle of removing soil from the carpet by liquidizing all of the soil initially present and catching and removing the liquidized soil in a high velocity air stream. These processes do not create noticeable suds or foam on the surface of the carpet since those skilled in the art have believed that suds or foam interfere with efficient removal of the liquidized soil and the water applied to the carpet by vacuum method. These processes, moreover, do not appreciably restore the texture of the carpet (i.e. relieve crushing and matting of piled) or remove surface debris and deep down dry dirt embedded near the base of the pile. As a consequence, additional cleaning steps are needed to restore the carpet to its original beauty and cleanliness so as to achieve a commercially acceptable cleaning job.

Another method often used to clean carpets is the shampoo method. In this method, a very dense, thick, nonflowing foam of the consistency of aerosal shaving foams is generated and applied to the surface of the carpet. This foam is worked into the carpet by a revolving brush. This method is effective in removing soil at surface level but often fails to remove deep down embedded dirt at the bottom of the carpet pile. In addition, if excess foam is applied to the carpet, streaking often occurs. Often these shampoo methods using a thick foam, are utilized in conjunction with an apparatus that also vacuums the carpet to take up the thick foam in addition to working the carpet with a revolving brush. While this method removes some loose, dry dirt near the base of the carpet pile, it fails to remove soil attached to the carpet fibers near the base of the pile since in practice the foam does not penetrate to the base of the pile. In addition, large amounts of a defoamer must be added to the vacuum system to break up the thick shaving cream like foam and to prevent temporary occulsion or plugging in the vacuum lines and overflowing of the soil receivers.

SUMMARY OF THE INVENTION

It is an object of this invention to provide an improved apparatus to clean a soiled surface such as walls, ceilings, floors, upholstery and carpets.

It is another object of this invention to provide an improved vacuum apparatus for cleaning soiled surfaces that utilizes a unique foam that does not require large amounts of defoaming agent to prevent plugging or occulsion in the vacuum lines, but has sufficient chemical activity to loosen and suspend soil within practical resident time, and in addition, remaining residue will not increase the soiling rate as compared to the soiling rate of a new uncleaned carpet.

It is a further object of this invention to provide an improved apparatus for cleaning carpets wherein the cleaning element can be effectively used in both a forward and backward direction.

It has been discovered that if a low stability, wet, flowable foam is created in a single step from a relatively small amount of detergent solution with a high velocity air stream, a large portion, if not all, of the film dirt present in a soiled surface, such as a carpet, will be suspended in the foam and, when the foam is removed from the carpet, preferably by vacuum, a clean surface is produced which contains little residual moisture. As a consequence, the carpet is not out of service for prolonged periods of time. The foam produced must not be of the thick, non-flowing consistency heretofor used by the art in the brush methods of carpet cleaning nor can the foam be of an unstable form with little consistency such as encountered in ordinary home washing machines.

It has also been discovered that when a prior art suction head is modified to provide vacuum openings or slots both before and behind the liquid spray nozzles within the same head, inferior results to that obtained with a single vacuum slot positioned ahead of the spray nozzles is obtained, particularly when utilized to clean carpets with the unique foam previously described herein. In fact, it has been found that when such a modified head is utilized, carpet fuzz and grit builds up beneath the spray nozzles between the two vacuum slots which interfere with the deposition of detergent on the carpet surface and withdrawal of foam and dirt from the carpet surface. It was discovered that this problem was caused by air entering the vacuum slots from only around the outer edges of the slots or in other words from the exterior of the head thereby creating a more or less "dead" air space inside. When air was allowed to flow to the vacuum slots from both the interior and exterior of the head, by providing an opening in the suction head a superior suction head was produced.

Accordingly, in one embodiment, the present invention relates to a method for cleaning a soiled surface, such as a carpet, including applying a liquid detergent to the soiled surface, contacting the soiled surface containing the detergent with a high velocity air stream to produce a unique, low stability, wet flowable foam and removing the thus produced foam and entrained soil from the surface. This foam has suspended in it soil removed from the soiled surface and provides a cleaned surface when the foam is removed such as by vacuum. When the surface cleaned is a carpet, the soil may be removed deeply from the base of the pile. Preferably the high velocity air stream is created by drawing a vacuum through an opening in a cleaning device wherein the opening is positioned against the soiled surface. The air drawn into the opening by the vacuum creates the high velocity air stream that contacts the moist detergent containing carpet to produce the described foam in the carpet. Preferably the air stream has a velocity of about 30 to 50 miles per hour through the carpet pile.

In another embodiment, the present invention relates to a new and improved suction head for a surface vacuum cleaning apparatus to clean a soiled surface such as a carpet. This suction head includes a surface contacting glide shoe having spaced apart slots positioned on the bottom surface contacting face of the shoe wherein one slot is positioned adjacent to the leading edge of the shoe and another slot is positioned adjacent to the trailing edge of the shoe. Each of these slots is in fluid communication with a vacuum conduit adapted to be connected at one end to a suitable vacuum source. A nozzle for discharge of a detergent containing fluid to the surface to be cleaned is positioned within the suction head between the spaced apart slots and above the bottom surface contacting face of the glide shoe. A suitable opening is provided in the suction head so as to enable air to pass to the soiled surface being cleaned through the interior suction head. This opening permits air to flow past the nozzle in the direction in which the cleaning fluid is expelled from the nozzle, between the slots of the glide shoe and into said slots from both sides thereof to eliminate fuzz and grit build up in the interior of the shoe between the glide shoe slots and the nozzle. This glide shoe can be of a rigid non-absorptive material, such as plastic for cleaning carpets or it can be manufactured from a sponge-like material for cleaning walls and floors. Preferably the slot on the base of the glide shoe defines a sharp right angle with the bottom surface of the glide shoe to assure that the maximum air velocity of the air entering the slot is downstream of the slot and within the carpet rather than in the slot proper. The base of the glide shoe can be formed in any of a number of shapes, such as rectangular, circular or triangular.

Other objects and embodiments will become apparent from the following more detailed description of the present invention.

BRIEF DESCRIPTION OF THE DRAWINGS

Particular preferred embodiments of the present invention are illustrated in FIGS. 1 – 15 which are attached hereto.

DETAILED DESCRIPTION OF THE INVENTION

Figure 15:
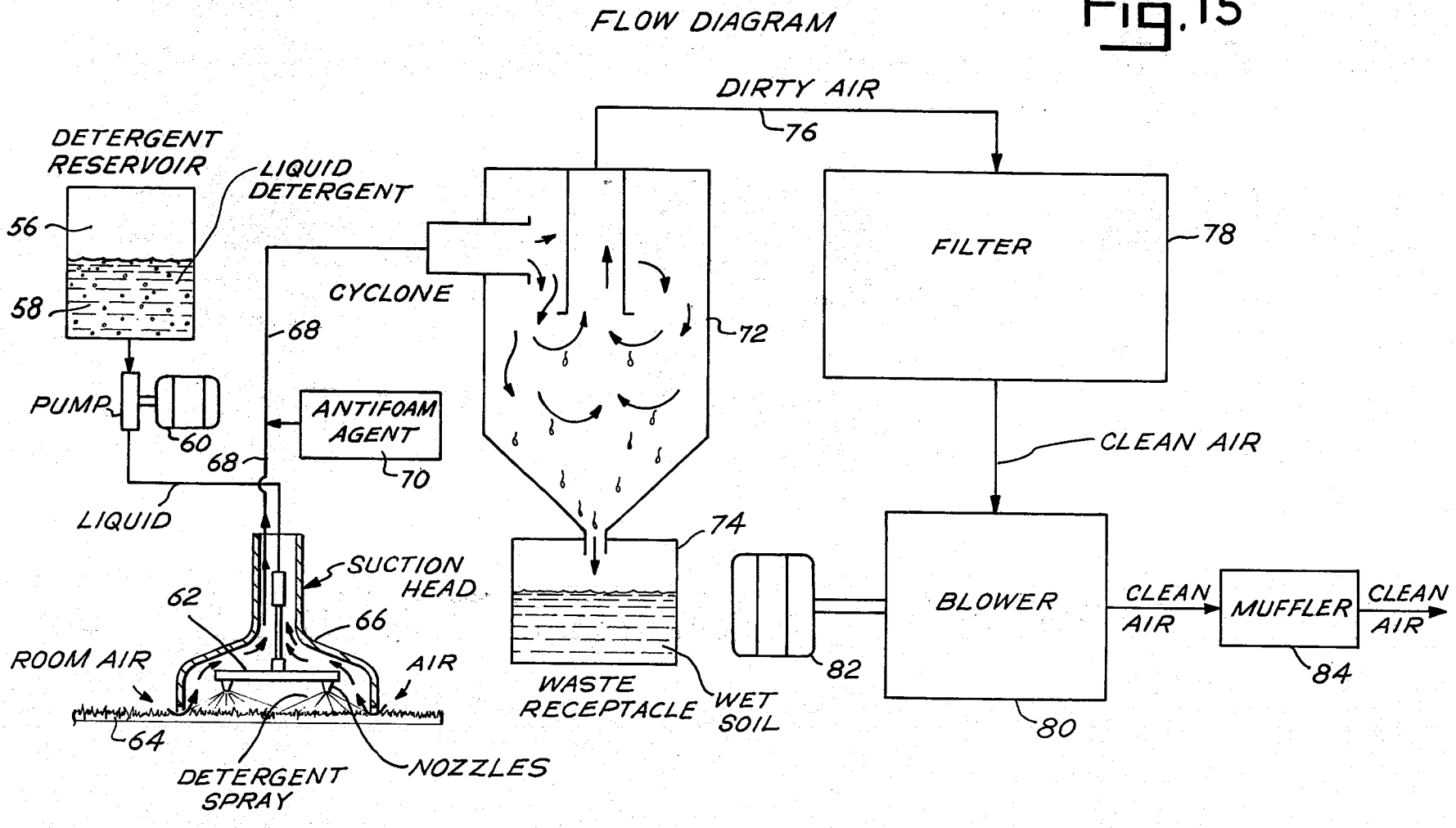
FIG. 15 is a schematic, flow diagram illustrating the unique method of the present invention which is incorporated in the carpet cleaning apparatus illustrated in FIGS. 1 and 6.

Referring first to FIG. 15, there is illustrated a schematic flow diagram of the principles embodied in the method and apparatus of the present invention. Detergent solution 58 is withdrawn from detergent reservoir 56 by pump 60 and applied to the surface of a carpet 64 by spray nozzles 62 in predetermined amounts. SImultaneously, in the same step, a vacuum created by blower 80 withdraws room air beneath the edges of the suction head 66 (see FIG. 7) to create a high velocity air stream between the fibers in the carpet pile and to produce a low stability, wet, flowable foam. This foam is in marked contrast to the high stability, dry, non-flowable foams heretofore used by the art in conjunction with rotating bristle carpet scrubbers that stay on the surface of the carpet and do not penetrate deeply into the carpet pile. The foam produced in accordance with the present invention has a low stability, i.e., it will decompose within a few minutes and is flowable, i.e., if placed on a 45° inclined plane, it will float to the bottom rather rapidly. As a consequence, the foam willl penetrate deeply into the carpet pile to remove imbedded dirt. Two factors are important in producing a foam of this consistency. One is air velocity and the other is detergent identity and/or concentration. For example, a concentrated detergent solution containing 14 weight percent sodium lauryl sulfate wherein the sodium sulfate is about 30% active, when added to tap water to provide a concentration within the range of ⅛ ounce of concentrated detergent solution per gallon to about 2 ounces of concentrated detergent solution per gallon will produce a foam of the desired consistency, when contacted with a high velocity air stream, i.e. about 30–50 mph. If 4 ounces of detergent solution per gallon are utilized, the foam produced will be stable, still and non-flowing and will approximate those foams heretofore used with rotary brush scrubbers and is unsuitable to deep clean a carpet. Preferably, the described detergent solution is applied at the rate of two to three gallons of total solution per 100 square feet of carpet to produce a thorough, deep cleaning of a typically soiled carpet. This is in contrast to the 5 to 10 gallons of liquid applied per 100 square foot amounts used in the prior art steam cleaning process.

This difference in result occurs because in the present invention, two things occur before the use of detergent. First, the matted fibers are lifted and air passages to the base of the pile are opened by vacuum. Next, a large amount of the soil 70–95% by weight and bulk) are removed in a dry state by air vacuum alone, thus considerably reducing the amount of soil to be removed by liquid means. The removal of the loose bulkier soil leaves behind film attached soils which require liquidization to be removed. In steam cleaning the bulk soil and the film soil are removed simultaneously. This however, requires a large amount of detergent solution. Thus, since the present invention uses small amounts of water, long evaporation times, risk of mildew formation, dye damage and carpet shrinkage are avoided.

In any event, the foam created according to the present invention, penetrates deep into the pile of carpet 64 and is withdrawn from the carpet pile in admixture with dirt contained in the carpet through vacuum conduit 68. A suitable anti-foam agent 70 is admixed with the foam on conduit 68 so that the foam is reduced to liquid droplets in the air and can be readily separated in the conventional cyclone separator 72. Such anti-foam agents are well known to those skilled in the art and include the dimethylpolysiloxanes and other modified silicones. Particularly preferred anti-foam agents are the SAG silicone anti-foams marketed by Union Carbide Corporation. In any event, the foam is decomposed in conduit 68 downstream from the point of addition of the anti-foam agent 70 and is passed to cyclone separator 72 wherein the grreatest part of waste water containing the dirt removed from the carpet is removed through waste receptacle 74 for suitable discharge. Since the foam has low stability, large amounts of anti-foam agent are not required. The air steam 76, with the small amount of liquid, recovered in cyclone separator 72 is passed through a conventional air filter 78 to provide a clean airstream to blower 80 driven by motor 82. The resultant clean air is then passed through muffler 84 to provide a quiet clean air exhaust stream for discharge into the room.

Figure 1:
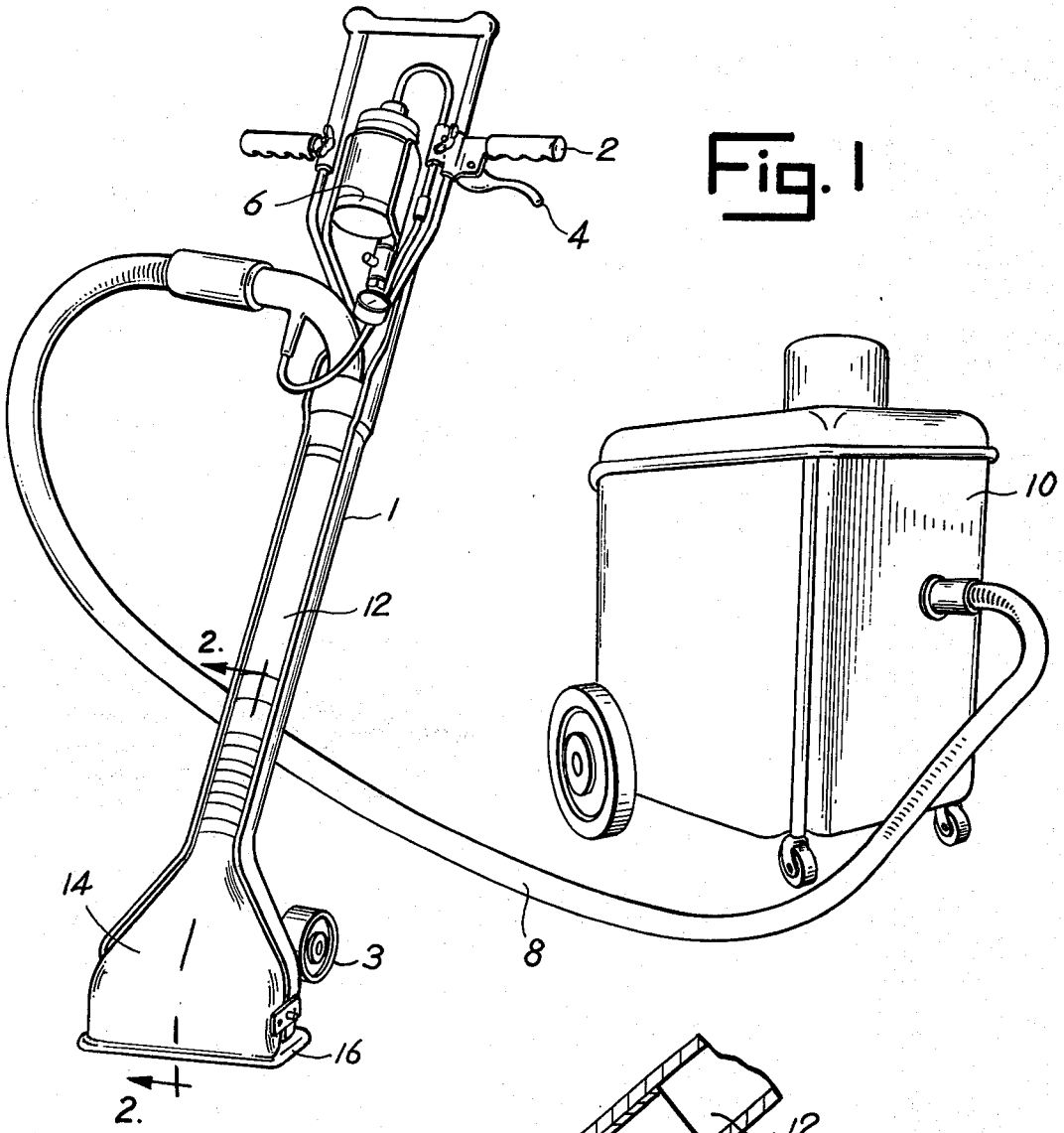
FIG. 1 is a perspective view of a cleaning apparatus embodying the suction head of the present invention and which may be utilized to clean carpets as well as floors according to the process of the present invention.
Figure 2:
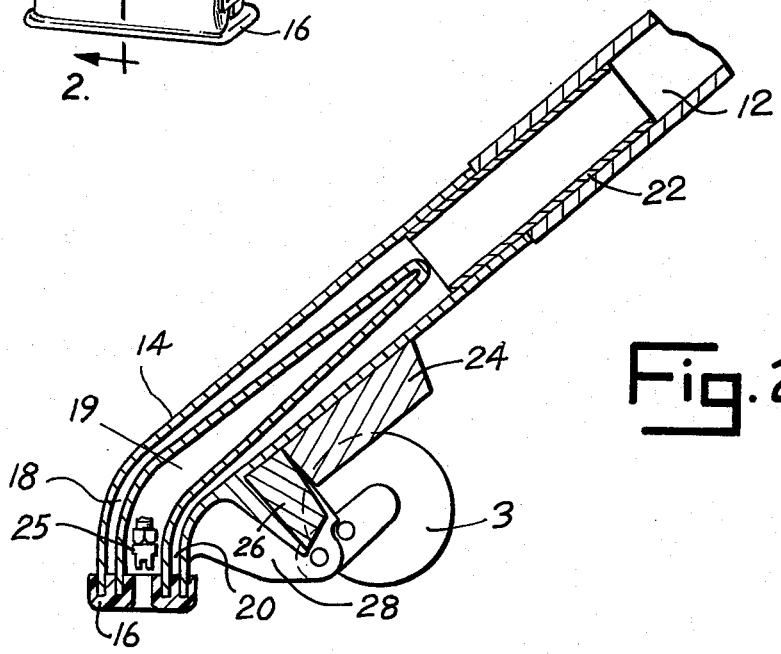
FIG. 2 is a detailed side cross-sectional view of a lower portion of the cleaning apparatus illustrated in FIG. 1 taken along line 2 — 2 in FIG. 1.
Figure 3:
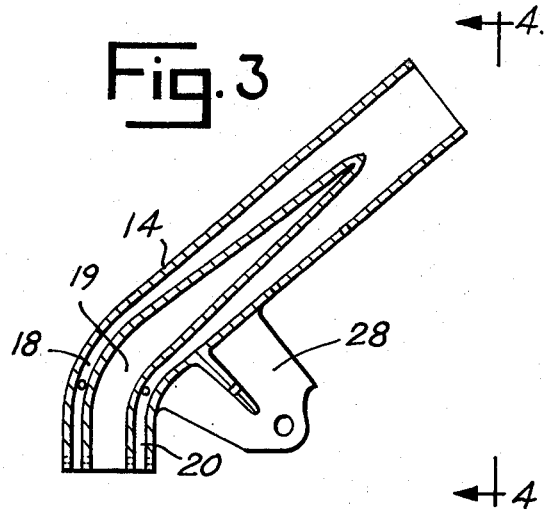
FIG. 3 is a detailed cross-sectional view of the suction head illustrated in FIG. 2.
Figure 4:
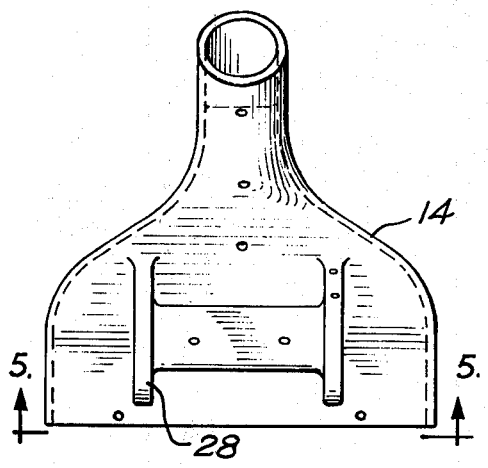
FIG. 4 is a rear, plan view of the suction head taken along line 4 — 4 in FIG. 2.

Referring now to FIG. 1, there is illustrated in perspective a carpet cleaning device 1 embodying a suction head 14 in accordance with the present invention. suction head 14 is connected to a clear plastic vacuum tube 12 which permits the operator to view the soil being removed from the carpet. Vacuum tube 12 in turn is connected to vacuum line 8 and service module 10 which contains the detergent reservoir, pump, cyclone, filter, blower, waste receptacle and muffler components shown schematically in FIG. 15. During transportation, cleaning device 1 is manipulated on wheels 3 by handles 2. Wheels 3 are retracted during the cleaning operation. The amount of detergent solution passed to the carpet surface is controlled by liquid feed control 4. A suitable anti-foaming agent is added to conduit 8 in small predetermined amounts from foam control reservoir 6 to break up the foam produced on the surface of the carpet cleaning tool 1.

Suction head 14 comprises a pair of spaced apart suction nozzles 18 and 20 separated by an opening 19. A glide shoe 16 is positioned on the bottom of suction nozzles 18 and 20 to insure smooth contact between tool 1 and the carpet surface. Weights 24 and 26 positioned adjacent to mounting bracket 28 and wheel 3 provide pressure to insure that the air passing through carpet does not bypass the unit.

It is also believed that the flexing and unflexing of the carpet pile as the weighted tool bears against it is beneficial in loosening and liquidizing soil, i.e., massaging effect.

Suction head 14 is preferably manufactured from cast metal and is provided with amon-absorptive glide shoe 16 manufactured from a suitable long wearing abrasion resistant plastic material. Although glide shoe 16 is illustrated as a replaceable separate component it could be integrally incorporated into suction head 14 during manufacture thereof. Suction head 14 is connected to extraction tube 12 by a suitable connecting pipe 22 that fits snugly on the interior of the end portions of suction head 14 and extraction tube 12.

Figure 5:
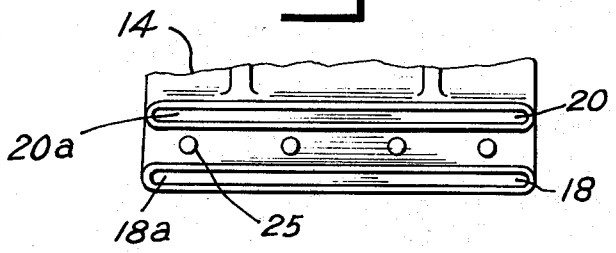
FIG. 5 is a bottom, plan view of the suction head taken along line 5 — 5 in FIG. 4.

As shown in greater detail in FIG. 5, spaced apart suction nozzles 18 and 20 have a continuous elongated slot 18*a* and 20*a* respectively incorporated therein for withdrawal of air from the pile of the carpet. Suitable spray nozzles 25 are positioned at spaced apart intervals within opening 19 and above glide shoe 16 to spray the detergent solution on the carpet, as discussed in relation to FIG. 15, so as to thereby produce a low stability, wet, flowable foam when contacted by the air flowing into slots 18*a* and 20*a*. The foam suspends soil present in the soiled carpet. This foam, with soil contained therein, is then withdrawn up through suction nozzles 18 and 20, through extraction tube 12, vacuum line 8 and passed to service module 10. Air is able to enter into the slots 18*a* and 20*a* in suction members 18 and 20 along both sides of the slots, i.e., from both the interior and the exterior of the head due to the opening 19 between the suction members. This is essential to eliminate fuzz and grit build-up between the slots 18*a* and 20*a*.

Figure 6:
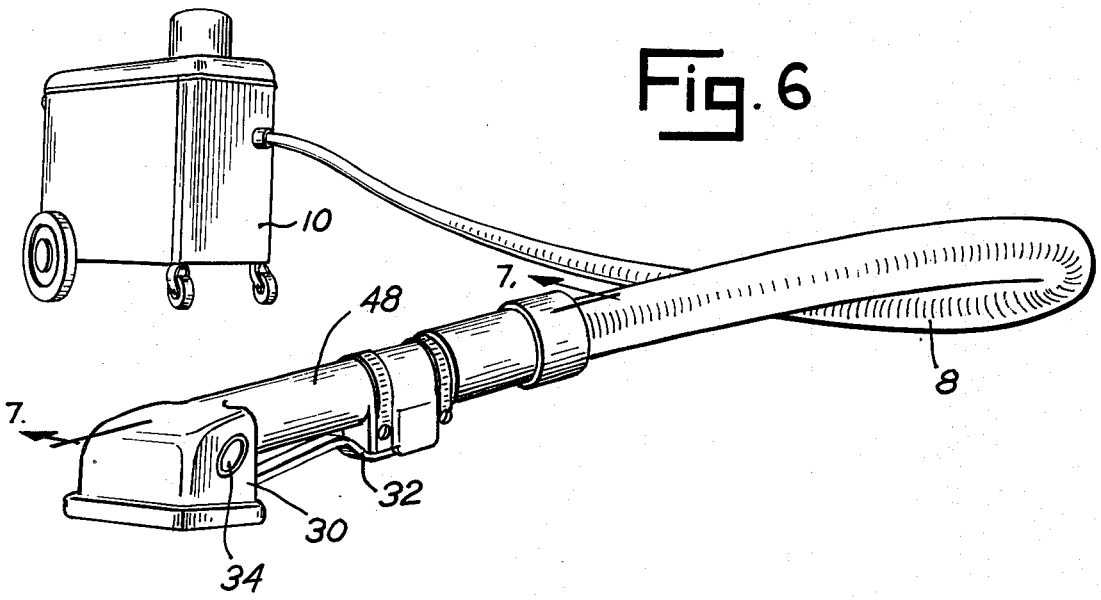
FIG. 6 is a perspective view of a cleaning apparatus utilizing a hand operated suction head which embodies the principles of the present invention and which is useful for cleaning concentrated and/or isolated dirty spots on a carpet or upholstery.

Referring to FIG. 6, there is illustrated a hand held suction head 30 for cleaning isolated or badly soiled spots on a carpet or upholstery surface. This hand held suction head 30 has a neck portion 48 connected with the service module via the line 8, in the same manner as illustrated in FIG. 15. Liquid control valve 32 controls the amount of detergent solution applied to the surface of the carpet.

Figure 11:
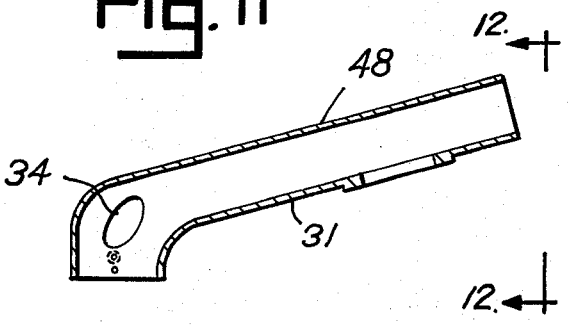
FIG. 11 is a cross-sectional view of the outer housing of the suction head shown in FIG. 6.
Figure 12:
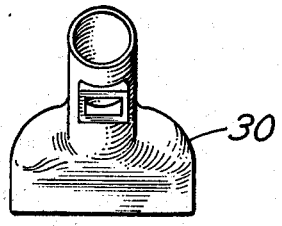
FIG. 12 is an end plan view of the outer housing taken along line 12 — 12 in FIG. 11.
Figure 13:
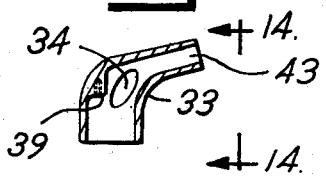
FIG. 13 is a cross-sectional view of an inner housing placed within the outer housing illustrated in FIG. 11 to provide the suction head construction illustrated in FIG. 7.
Figure 14:
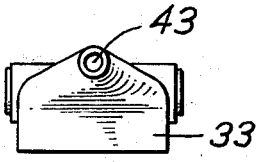
FIG. 14 is an end plan view of the inner housing illustrated in FIG. 13 taken along line 14 — 14.
Figure 7:
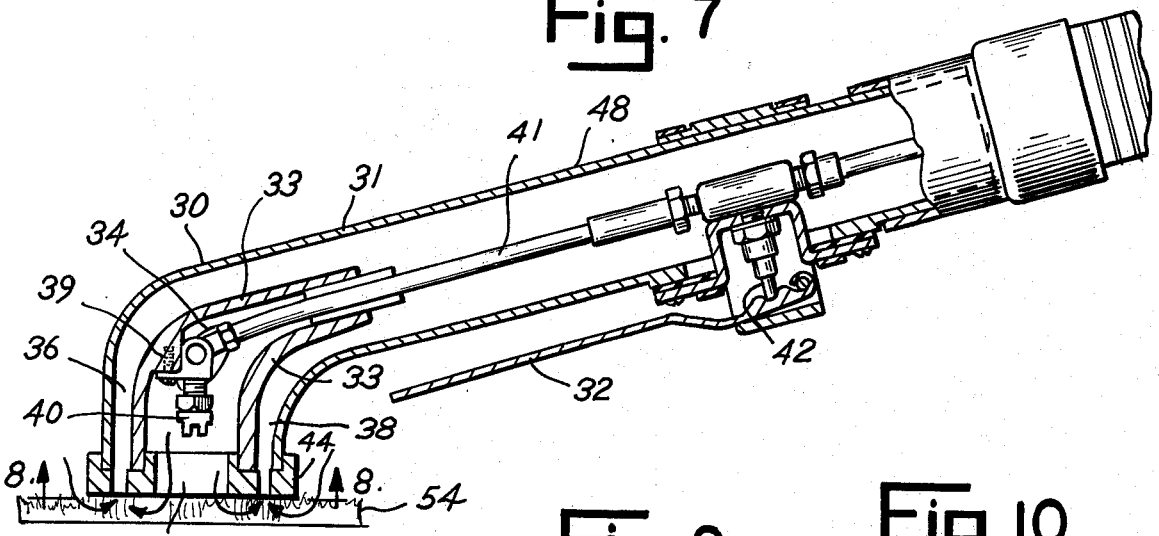
FIG. 7 is a vertical cross-sectional view of the suction head taken along line 7 — 7 in FIG. 6.
Figure 8:
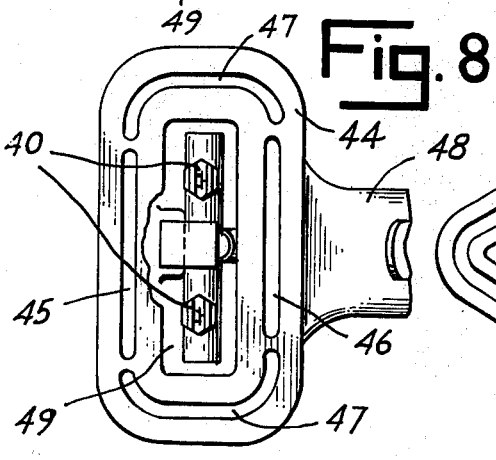
FIG. 8 is a bottom, plan view of the suction head taken along line 8 — 8 in FIG. 7.

Hand held suction head 30 is illustrated in further detail in FIGS. 7 and 8. Suction head 30 comprises an outer housing 31 having concentrically disposed therein a smaller, spaced apart inner housing 33. Outer housing 31 is illustrated in further detail in FIG. 11 and 12. Inner housing 33 is illustrated in further detail in FIGS. 13 and 14. Inner housing 33 and outer housing 31 cooperate to form a forward suction conduit at nozzle 36 and a rear suction conduit on nozzle 38 in fluid communication with vacuum conduit 48 which also forms the hand held neck of the tool connected to vacuum line 8. Actually, the entire spacer between the inner and outer housing is a fluid communication with vacuum conduit or neck 48. Spray nozzle 40 is connected to shoulder 39 on the interior of inner wall 33. Liquid conduit 41 passes through opening 43 in inner housing 33 and to spray nozzle 40. Flow through conduit 41 is controlled by control valve 42 which is actuated by hand operated control valve handle 32 positioned on the bottom side of neck 48.

Glide shoe 44 is positioned on the face of tool 30 to minimize friction between the tool and the carpet being cleaned. Glide shoe 44 includes a forward slot 45, a rear slot 46, and side slots 47 in fluid communication with the space between housings 31 and 33. Center opening 49 in glide shoe 44 is positioned immediately below spray nozzles 40 and between to permit liquid discharged therefrom to contact carpet 54. As illustrated in detail in FIG. 7, forward slot 45, rear slot 46, and side slot 47 form a sharp right angle with a face of glide shoe 44. This is important since the air drawn into the section 36 and 38 should have a maximum velocity outside of slots 45 and 46 to insure thorough contact with the detergent solution applied to the carpet and creation of the desired foam. If these slots had a rounded opening, the maximum velocity would occur within the slots and the full benefit of the air flow to the carpet pile to create the desired foam would not be obtained.

Figure 9:
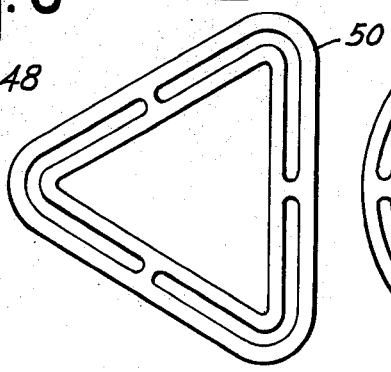
FIG. 9 is a bottom plan view of a triangular shaped glide plate which may be used with a suction head.
Figure 10:
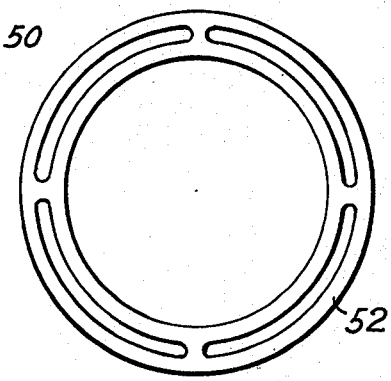
FIG. 10 is a bottom plan view of a circular glide plate which may be used with a suction head.

Illustrated in FIGS. 9 and 10 are alternative configurations for glide shoe 44 and hand extraction tool 30. Triangular glide shoe 50 illustrated in FIG. 9 is particularly suited for getting into hard to reach spots on a carpet surface. Circular glide shoe 52 illustrated in FIG. 10 can be used instead of the rectangular configuration illustrated in FIG. 8.

Openings 34 positioned on both side walls of inner housing 33 and outer housing 31 provide communication from the atmosphere to the interior of tool 30 when it is placed against a surface to be cleaned. As illustrated, two openings are used on head 30. However, these openings can be positioned above the entire periphery of the head. Similarly, a single opening can be utilized. The important thing is to allow air to flow down between slots 45 and 46 so that air can enter these slots from both directions, i.e., from both the exterior and the interior of the head. As discussed earlier, this opening is necessary to insure effective operation of the head and air flow into both sides of the slots in glide shoe 44. Opening 34, however, is not in direct fluid communication with conduits 36 and 38. Rather this opening is isolated from these conduits as it passes through the vacuum head. Air entering opening 34 can enter conduits 36 and 39 only through slots 45, 46, and 47.

In operation, the vacuum imposed by service module 10 through line 8 draws air through the pile of the carpet 54 primarily via forward suction conduit 36 and rear suction conduit 38. SImultaneously, liquid detergent is expelled through spray nozzle 40 into the carpet pile. When this detergent is contacted by the high velocity air stream moving through the carpet pile due to the vacuum imposed thereon, a low stability, wet, flowable foam is formed that reaches down to the base of the carpet pile and removes not only the dirt physically attached to the fibers in the carpet pile, but also effectively removes loose dirt contained at the base of the carpet. The formation of this foam is analogous to the mixing of gasoline and air in a carburetor due to the passage of air through a constricted opening.

An advantage of the foam produced in the apparatus and method of the present invention is that it requires small amounts of water to effectively clean a carpet. Since small amounts of water are required, i.e., only 2 to 3 gallons per hundred square feet of carpet, the carpet is ready for normal use in a relatively short period of time. In addition, the carpet is cleaned thoroughly since more than just the mere superficial exposed surface of the carpet is cleaned. As a consequence, the carpet stays cleaner for a longer period of time since there is no hidden dirt to migrate to the surface of the carpet and produce a soiled appearance.

Further, because the foam produced has little stability, as the foam is withdrawn through conduit 8 liquid plugs or slugs will not form. This is important because if liquid plugs or slugs would form within conduit 8, a steady, uniform vacuum could not be produced. Rather, during the presence of the liquid plugs or slugs, there would be no vacuum imposed on the carpet surface, and this would result in spots of high water concentration that would require longer periods to dry out and would leave behind residual dirt to appear as stains.

I claim as my invention:

1. An improved suction head for a vacuum cleaning apparatus adapted to clean a soiled surface, which comprises in combination:

a surface-contacting glide shoe having a leading edge, a trailing edge, and a bottom, contacting face;

a vacuum conduit adapted to be connected at one end to a vacuum source;

said glide shoe having spaced apart slots positioned on the bottom face of the shoe, one slot positioned adjacent to the leading edge of the shoe, and another slot positioned adjacent to the trailing edge of the shoe with an intermediate opening between the slots;

said slots being in fluid communication with the vacuum conduit.

nozzle means for discharge of a fluid through the intermediate opening onto the subjacent surface, said nozzle means being positioned between the spaced apart slots and above the bottom face of the shoe;

means for supplying cleaning fluid to said means located above said bottom face for communicating the intermediate opening with ambient air through the above the bottom face through the interior of the suction head, to permit air to flow in the direction of discharge of the cleaning fluid and between said slots to the intermediate opening to provide external air flow into said slots from the exterior of the head and from the intermediate opening, whereby the accumulation of grit and other material in the region between the slots and the intermediate opening is prevented.

2. An improved suction head as in claim 1, wherein said slots define a right angle with the bottom face of the shoe.

3. An improved suction head as in claim 1, which includes a housing wherein said nozzle means and vacuum conduit are enclosed in said housing and the cummunicating means comprises at least one opening in the wall of the housing.

4. A suction head as in claim 3 which includes a pair of concentric, spaced apart housings to define said vacuum conduit therebetween, said nozzle means positioned within the interior of the inner housing, and the cummunicating means comprises at least one opening through both housings isolated from said vacuum conduit.

5. An improved suction head as in claim 1, wherein said slots are positioned around the entire perimeter of the glide shoe.

6. An improved suction head as in claim 1, wherein the contacting face of the glide shoe is made of nonabsorptive material.

7. An improved suction head as in claim 1, wherein said glide shoe is rectangular.

8. An improved suction head as in claim 1, wherein said glide shoe is triangular.

9. An improved suction head as in claim 1 wherein said glide shoe is circular.

10. In an apparatus for cleaning soiled surfaces which includes a liquid supply source and a vacuum source to remove soil and liquid from the soiled surface, an improved cleaning suction head which comprises;

a surface-contacting glide shoe having a leading edge, a trailing edge, and a bottom contacting face;

a vacuum conduit adapted to be connected at one end to the vacuum source;

said glide shoe having spaced-apart slots positioned on the bottom face of the shoe, one slot positioned adjacent to the leading edge of the shoe, and another slot positioned adjacent to the trailing edge of the shoe, said slots being spaced from each other and an intermediate opening being defined in said bottom surface therebetween;

said slots being in fluid communication with the vacuum conduit;

nozzle means for discharge of a cleaning fluid onto the subjacent surface, said nozzle means positioned in communication with the intermediate opening between the spaced-apart slots and above the bottom of the shoe, said nozzle means also being in communication with the liquid supply source;

means for supplying cleaning fluid to said nozzle means; and means located above said bottom face for communicating the intermediate opening with ambient air through the interior of the suction head, to permit air to flow in the direction of discharge of the cleaning fluid and between said slots to the intermediate opening to provide external air flow into said slots from both the exterior of the head and from the intermediate opening whereby the accumulation of grit and other material in the region between the slots and in the intermediate opening is prevented.

* * * * *